United States Patent [19]

Crawford

[11] 4,244,142

[45] Jan. 13, 1981

[54] PUPPET RUG FOR THERAPEUTIC PURPOSES

[76] Inventor: Robert L. Crawford, 1323 Heulu St., Apt. 402, Honolulu, Hi. 96822

[21] Appl. No.: 939,965

[22] Filed: Sep. 6, 1978

[51] Int. Cl.[3] ..... A63H 3/14; A63H 3/36; A63H 7/00; G01S 17/00

[52] U.S. Cl. ..... 46/154; 46/116; 46/126; 46/171; 434/262

[58] Field of Search ..... 46/126, 116, 154, 171, 46/152; 35/DIG. 2, 55, 56, 49, 29 E, 20, 15; 5/482, 495, 334; 130/37

[56] References Cited

U.S. PATENT DOCUMENTS

| | | | |
|---|---|---|---|
| 961,812 | 6/1910 | Siegel | 46/154 |
| 2,302,844 | 11/1942 | Ebbott | 5/482 |
| 2,795,896 | 6/1957 | Snyder | 46/154 |
| 2,929,170 | 3/1960 | Brown et al. | 46/154 |
| 3,060,462 | 10/1962 | Miller | 5/482 |
| 3,308,479 | 3/1967 | Sesco, Jr. | 46/154 |
| 3,778,925 | 12/1973 | Owen | 46/154 |
| 3,942,283 | 3/1976 | Rushton | 46/154 |
| 4,062,076 | 12/1977 | Albertson | 5/482 |

*Primary Examiner*—Gene Mancene
*Assistant Examiner*—Michael J. Foycik, Jr.

[57] ABSTRACT

A puppet rug that resembles a skinned animal, human, or an imaginary character. The head of which can be manipulated so as to mimic an animal, a human, or an imaginary character. The head is lined and stuffed to keep its shape when it is in use as a puppet. The body is lined, but not stuffed. It has a large surface area so that a child can play on it, sleep on it, sit on it, and wrap himself in it. It is designed to provide visual and tactile stimulation. It may be used as a toy, a puppet, or as a decorative object. It may be used in the treatment of tactually defensive children to overcome their fears of being touched. Its large surface area facilitates the development of good feelings needed to produce the treatment goal.

1 Claim, 6 Drawing Figures

PUPPET RUG FOR THERAPEUTIC PURPOSES

BACKGROUND OF THE INVENTION (1) Field of the Invention

Combination of hand puppet and rug used for therapeutic purposes.

(2) Description of the Prior Art

The prior art includes hand puppets, puppet dolls or toys, and combination of puppet and stuffed animal. It does not include a puppet rug which can be used for therapeutic purposes.

(3) Prior Art Statement

Rosen, U.S. Pat. No. 3,226,849, dated Jan. 4, 1966, discloses a slipper which may be used as a toy in the nature of a hand puppet.

Rushton, U.S. Pat. No. 3,942,283, dated Mar. 9, 1976, discloses a hand puppet which resembles a stuffed animal.

None of the prior art discloses a puppet rug which can be used for therapeutic purposes. My invention provides a puppet rug which can be used for therapeutic purposes.

SUMMARY OF THE INVENTION

The invention relates to a puppet rug which is used in the treatment of tactually defensive children to overcome their fears of being touched. It is designed to provide visual and tactile stimulation.

An object of this invention is to provide a puppet rug which can be used in the treatment of tactually defensive children to overcome their fears of being touched.

Another object of this invention is to provide a puppet rug that can be used to teach mentally retarded individuals the concept of "soft" or "furry".

Still another object of this invention is to provide a puppet rug that can be used in the treatment of children with reduced sensory input.

Yet another object of this invention is to provide a puppet rug that can be used as a puppet, toy, or as a decorative object.

A further object of this invention is to provide a puppet rug which can be of any desired form, including animal, human, or imaginary.

A still further object of this invention is to provide a method for the treatment of tactually defensive children with a puppet rug.

Other objects, features and advantages of the present invention will be readily apparent from the following detailed description taken in connection with the accompanying drawings.

DESCRIPTION OF THE PREFERRED EMBODIMENT

Figure 1:
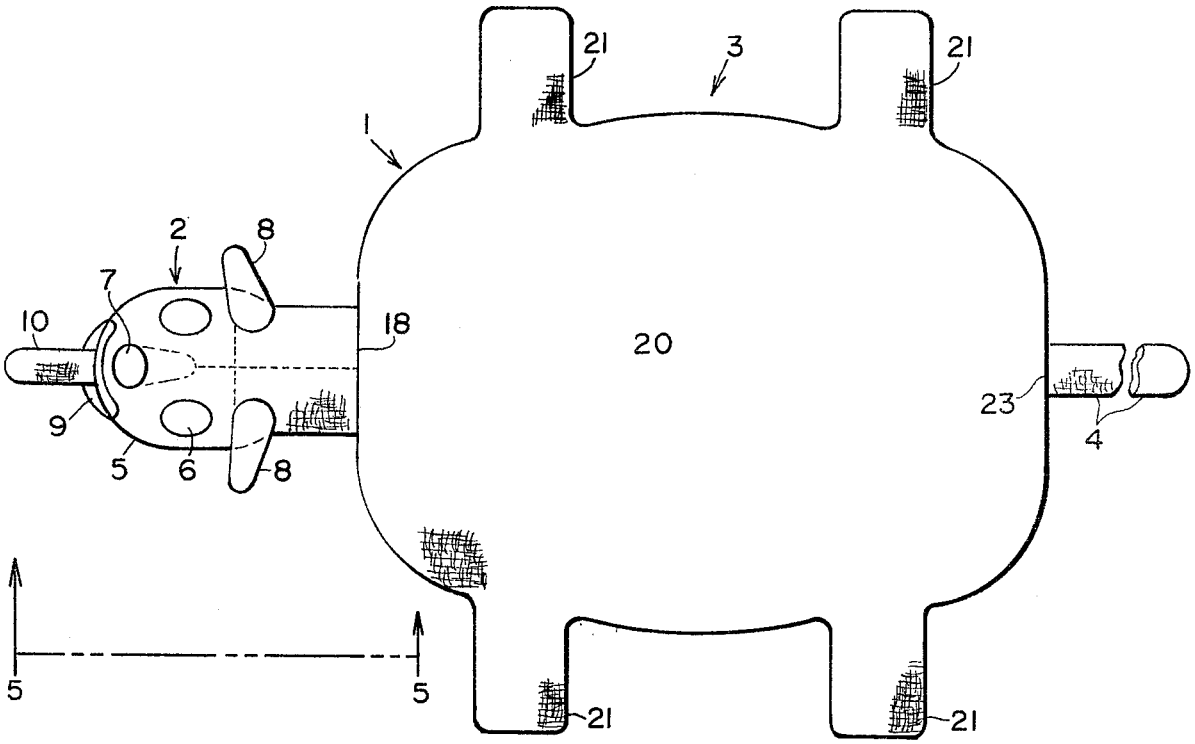
FIG. 1 is a plan view of the puppet rug in use as a rug.
Figure 2:
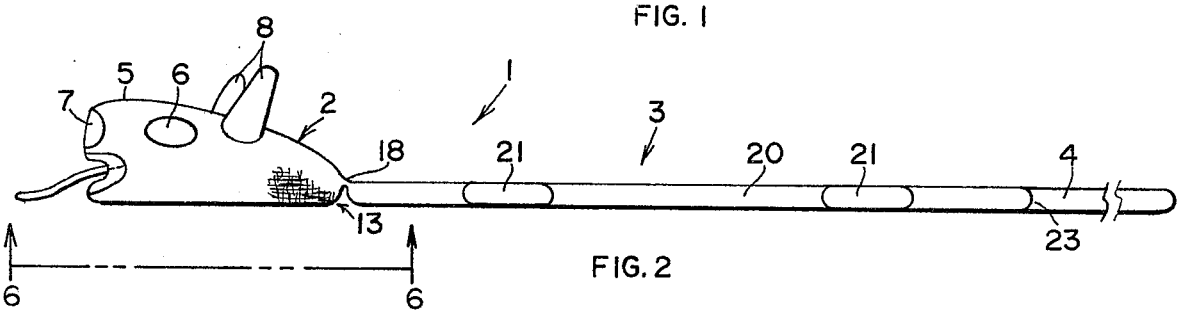
FIG. 2 is a side view of the puppet rug in use as a rug.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings wherein like reference numerals or letters refer to like and corresponding parts throughout the several views, the preferred embodiment of the invention disclosed in FIGS. 1–6 inclusive is indicated generally by reference numeral 1. Puppet rug 1 includes a head portion 2, a body portion 3, and a tail 4.

Head portion 2 includes head 5, eyes 6, nose 7, ears 8, mouth 9, tongue 10, cutting place 11, arm cavity 12, arm cavity opening 13, thumb cavity 14, fingers cavity 15, head lining 16, and stuffing 17. Head portion 2 is connected to body portion 3 at 18. Reference numeral 19 indicates the area of the head portion that is stuffed. Cutting place 11 is the place where a cut can be made so that tongue 10, which is hollow, can be manipulated by a finger or fingers. Stuffing lining 22 holds stuffing 17 in place, when its edges are sewed onto head lining 16.

Body portion 3 includes a body 20, limbs 21, and body lining 24. Body 20 and limbs 21 are lined by body lining 24. Body 20 and limbs 21 are skinned portions of a body and limbs of any desired animal, human, or imaginary form, which is the subject of the puppet rug.

Tail 4 is connected at 23 to body portion 3.

The length from nose 7 to place of attachment of head portion 2 to body portion 3, reference numeral 18, is 14 inches. The length from reference numeral 18 to place of attachment of tail 4, reference numeral 23, is 4 feet 6 inches. Tail 4 is 4 feet 5 inches in length and 3 inches wide. Ears 8 are 3 inches in length. Head 5 is 7 inches wide when measured while in use as a rug (flat). Arm cavity 12 is 12 inches in circumference. This allows an adult hand to enter and manipulate head portion 2 but does not allow a child's head to enter.

Body portion 3, tail 4, head 5, and ears 8 are made of synthetic fur material. Body portion 3 and head portion 2 are lined with suitable lining material, preferably black. Eyes 6, nose 7, mouth 9, and tongue are made of crepe material or single knit material. Any colors may be used. I used green for the eyes, black for the nose, and red for the mouth and tongue. Stuffing 17 is made of scrap pieces of synthetic fur material left over from cutting out body portion 3, tail 4, head 5, and ears 8. Stuffing area 19 is a pocket formed by sewing the edges of stuffing lining 22 onto head lining 16. Head 5 is made of a left piece and a right piece, which are sewn together. Ears 8, eyes 6, nose 7, mouth 9, and tongue 10 are sewn onto head 5. I used yellow synthetic fur material, but any other desirable colored synthetic fur material may be used.

Figure 3:
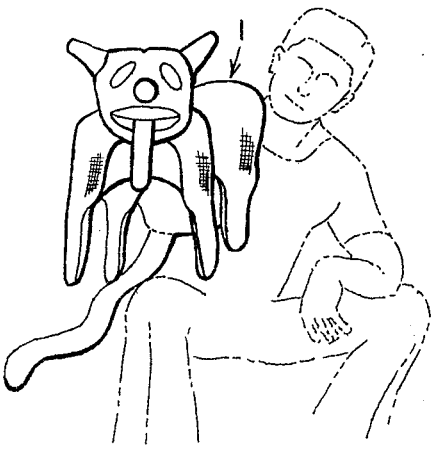
FIG. 3 is a front perspective view of the puppet rug in use as a puppet with a person shown in dotted lines.
Figure 4:
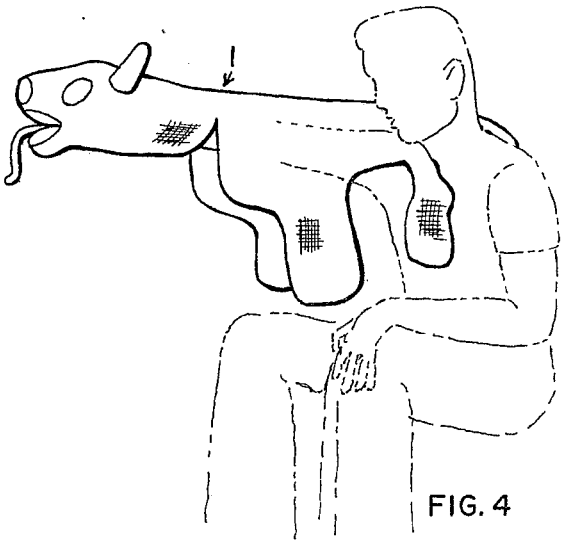
FIG. 4 is a side perspective view of the puppet rug in use as a puppet with a person shown in dotted lines.
Figure 5:
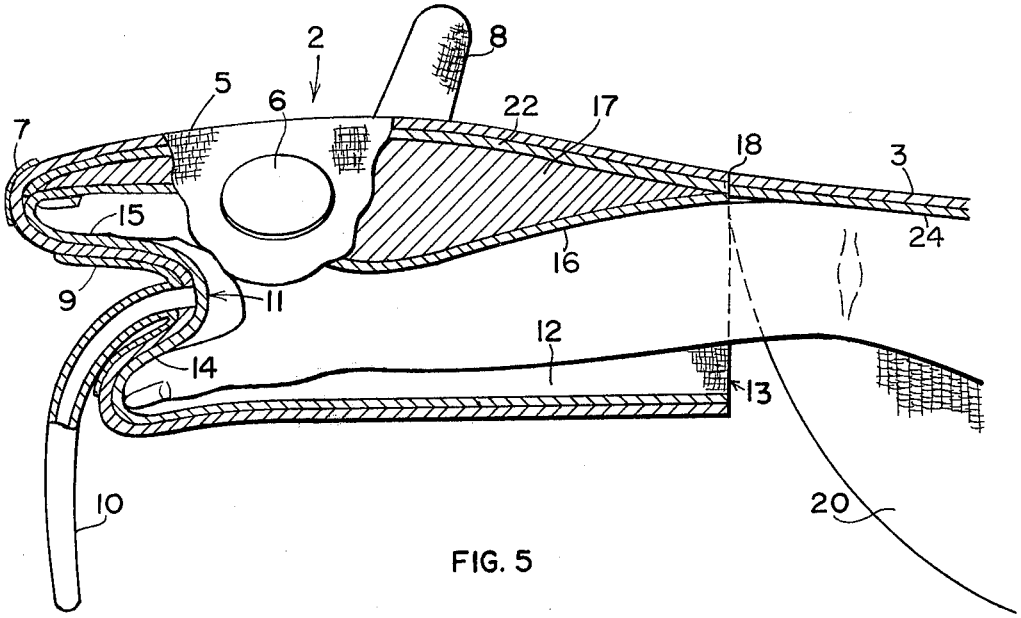
FIG. 5 is a sectional view of the invention taken on line 5—5 of FIG. 1 to illustrate the construction of the head portion and the position of a hand when the head portion is used as a puppet.
Figure 6:
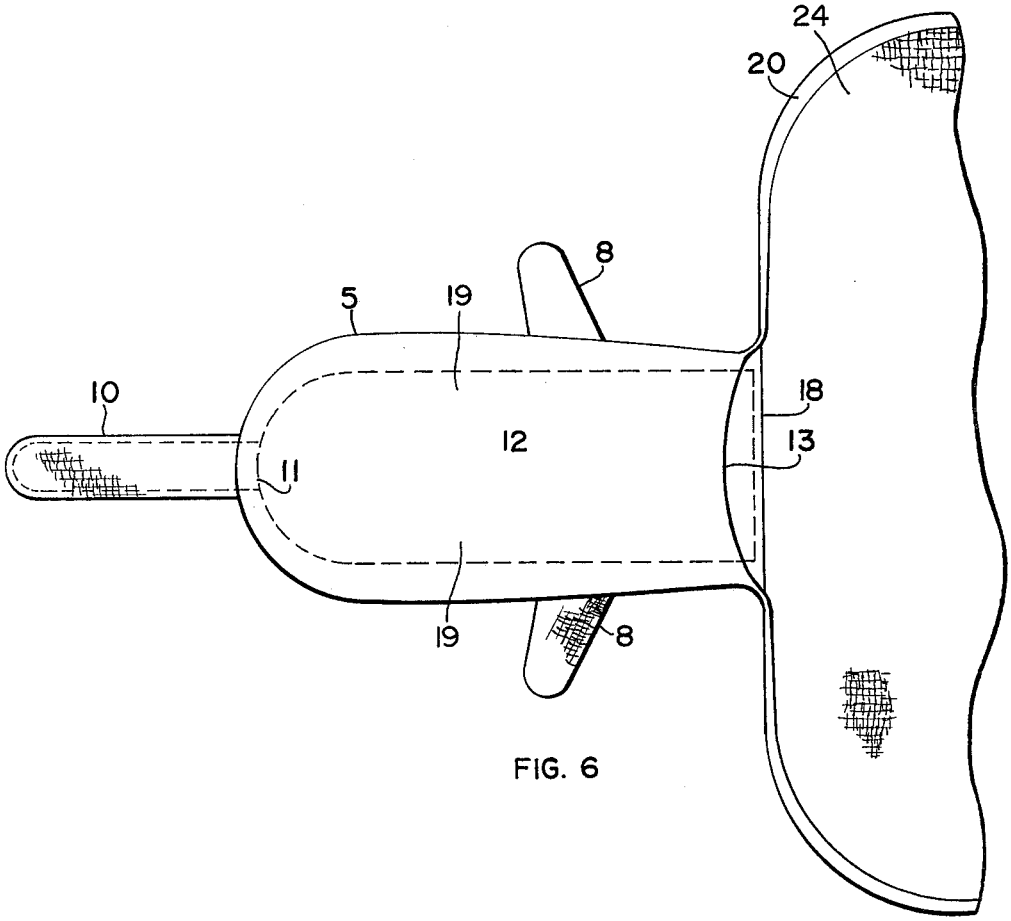
FIG. 6 is a bottom view of the invention taken on line 6—6 of FIG. 2 to illustrate the arm cavity opening of the head portion and the area of the head portion that is stuffed.

FIGS. 3–5 show the puppet rug in use as a puppet. FIG. 5 shows how a hand of a person fits within the head portion. Arm cavity 12 receives the arm of a person through arm cavity opening 13. Thumb cavity 14 receives the thumb of a person. Fingers cavity 15 receives the four fingers of a person. The thumb of the person operates the lower jaw section, while the four fingers of the person operates the upper jaw section. The four fingers may be independently moved to vary the contour of and animate the upper head and jaw section.

Puppet rug was invented to treat tactually defensive children. Tactually defensive children dislike to be touched by anyone. The tactually defensive child misses out on the love and warmth of parents, relatives, friends, and other children as expressed through touch. The child is a problem to feed, dress, bathe, or toilet train. The child may never outgrow being tactually defensive. The easiest time to correct being tactually defensive is in childhood, between one to ten years.

As on Occupational Therapist, I invented the puppet rug to treat tactually defensive children that were seen by me as I considered the known treatment to be inadequate. Recommended treatment prior to my invention took a month and a half with uncertain results. My invention with careful instructions and parental and family help takes about three weeks with better results. At the end of the treatment time the children were all inseparable from their puppet rugs and were comfortable with being touched.

The puppet rug is used to develop good feelings toward touching in an area a child who is tactually defensive is not threatened in. After the child develops good feelings in an area he is not threatened in, he is touched in areas he is threatened in. Slowly his fear is reduced until he can be touched by the puppet rug in use as a puppet and later by a human hand.

The method which I have used to treat tactually defensive children with my invention is as follows: (1) Show a picture of the puppet rug to the child and question the child of his knowledge of the picture. (2) Introduce and explain the puppet rug to the child. (3) Tell a story to the child about the puppet rug. (4) Have the child name the puppet rug. (5) Allow the child to explore the puppet rug at his own pace. (6) Allow the child to walk on the puppet rug with his shoes on. (7) Allow the child to walk on the puppet rug with his shoes off. (8) Allow the child to sit on the puppet rug with pants on. (9) Allow the child to sit on the puppet rug with shorts on. (10) Allow the child to lie down on the puppet rug. (11) Allow the child to sleep on the puppet rug. (12) Allow the child to roll up in the puppet rug. (13) Make an assessment of the child's feelings toward the puppet rug to determine whether he does have good positive feelings toward the puppet rug. If he does not have good positive feelings toward the puppet rug, the child is allowed to play with and experience it some more until he does have good positive feelings toward it. (14) Use the puppet rug as a puppet in a story to make it more personable and animated. (15) Allow the child time to adjust to the new role of the puppet rug and to develop good feelings toward it. (16) Use the puppet rug to give the child food he likes. The child is asked to take the food from his friend and is not threatened by any move of the person with the puppet rug toward him as if to touch him. (17) Ask the child if he likes his friend, the puppet rug. If the child says yes, the next step is taken; if the child says no, the child is allowed to gradually develop good feelings toward the puppet rug. (18) Warn the child that he is going to be gently touched by the puppet rug being used to give food or a toy he can keep. (19) Gently touch the child with the puppet rug. (20) Tell a story in which the puppet rug and the child can participate. The child interacts with the puppet rug by touching it and is touched back by it. (21) Reveal to the child, after the child has accepted the new role of the puppet rug as a puppet and has developed good feelings about it, that the puppet rug is actually held by a hand. (22) Cut a slit at cutting place 11 so that a finger or fingers of the therapist can be put into tongue 10. (23) Put a finger or fingers into tongue 10 and touch the child with the tongue. (24) Cut off the ends of tongue 10, have a finger or fingers protrude, and touch the child. (25) Allow the child to put his hand into the head portion 2 to convince himself that a hand does manipulate the head portion 2 and that a person's finger or fingers actually does protrude through tongue 10 to touch him. (26) Allow the child to touch the person's hand when it is in close proximity to the head portion 2. (27) Allow the child to touch the person's hand while holding or sitting on the puppet rug. (28) Touch the child without the puppet rug being present. By this time the child is comfortable with being touched.

It should be noted that all of the above steps may or may not be required in the treatment of a tactually defensive child. Should it be determined by the therapist that any of the above cited steps is not necessary in the treatment of the child, he may eliminate the unnecessary step or steps. For example, steps 22 to 25 may be eliminated if the child only needs an explanation and allows the therapist to touch him with the head of the puppet rug resting on top of the therapist's hand.

I have treated five children successfully with this method. The five children ranged in age from one to ten years of age. The treatment time varied, but with careful instructions and parental and family help the treatment time was about three weeks. This compared with a month and a half using the recommended treatment. At the end of the treatment, the children were all inseparable from their puppet rugs. They watched television on them, slept on them, took them to bed, dragged them around wherever they went, and even cried on them. The younger children considered the puppet rugs as their friends and companions.

Adults who came in contact with the puppet rug thought it was cute or unique. Not one of them said one word about it being therapeutic or that it should be picked up off the floor and put away. Adults viewed the puppet rug as a toy or a decorative object and not as a treatment modality. This attitude assisted the children's acceptance of the puppet rug. Moreover, since the puppet rug was acceptable to the families of the tactually defensive children, the treatment was assisted in that the children had extra time with the puppet rugs as they could use them at home.

The large surface area of the puppet rug assisted in the child's acceptance of it and also its acceptance by others and the avoidance of anything that would produce undesirable effects on the child. The large area allowed the child to use the puppet rug in a number of ways to develop the good feelings toward it needed to produce the treatment goal. The child could drag it, play on it, sit on it, roll up in it, sleep on it, and take it to bed with him.

The puppet rug may be used to teach mentally retarded individuals the concept of "soft" or "furry". The puppet rug allows a maximum amount of stimulation of the individual by the surface he is trying to form a concept of. Since the puppet rug is not just a surface with a particular feel, it can be named and the name can be the quality the individual is trying to learn. Individuals learned faster the concept of the surface when the puppet rug was used than when they were given a surface and requested to learn it. They also attended better to a large surface area that they could literally be wrapped up in.

The puppet rug may be used in the treatment of children with reduced sensory input. They need a lot of any sensation before they can feel it as normal people do. Their sensory receptors "fire" only when a lot of a sensation is present to stimulate them. The large surface area of the puppet rug provides for visual and tactile stimulation of these children.

Normal children respond well to the puppet rug. They enjoy dragging it, playing on it, sitting on it, rolling up in it, sleeping on it, taking it to bed with them, and using it as a puppet. They like to be told a story using the puppet rug. Some of the children allow the puppet rug to tell them things to do even though they would offer resistance to what their parents wanted them to do. The parent could tell his child what to do through the puppet rug. A parent noticed that his child would tell him things that he would not say except through the puppet rug. The many uses of the puppet rug allow a child to develop good feelings toward it and then the child could use it to express himself when he could not ordinarily.

The puppet rug may be of any desired form including animal, human, or imaginary. For example, it could be a bear, a man, a witch, or a monster. My invention combines the attributes of a rug with those of a puppet. It is contemplated that the puppet rug may have equipment added to it. For example, saddle bags on a burro or clothes on a Halloween Witch.

Although but a single embodiment of the invention has been disclosed and described herein, it is obvious that many changes may be made in the size, shape, arrangements and detail of the various elements of the invention without departing from the scope of the novel concepts of the present invention.

I claim as my invention:

1. A puppet rug for therapeutic purposes comprising a head portion connected to one end of a body portion; said head portion includes a head, eyes, an upper jaw, a lower jaw, a nose, ears, a mouth, and a tongue; said head portion having an arm cavity which communicates with a thumb cavity located in the area of said lower jaw and a finger cavity located in the area of said upper jaw; the arm cavity is initially sewed shut near the junction of said head portion and said body portion and is adapted to be opened by a therapist; said tongue is hollow and is adapted to be manipulated by the finger or fingers of a person; a covering over the opening of said tongue; said body portion including a body and limbs and is adapted for use as a rug, said body having a surface area large enough so that it may be used as a rug.

* * * * *